US010828211B2

(12) United States Patent
Jönsson

(10) Patent No.: US 10,828,211 B2
(45) Date of Patent: Nov. 10, 2020

(54) WHEEL DRIVE MECHANISM FOR PATIENT HANDLING EQUIPMENT

(71) Applicant: ArjoHuntleigh AB, Malmo (SE)

(72) Inventor: Jörgen Jönsson, Harlosa (SE)

(73) Assignee: ArjoHuntleigh AB, Malmo (SE)

( * ) Notice: Subject to any disclaimer, the term of this patent is extended or adjusted under 35 U.S.C. 154(b) by 171 days.

(21) Appl. No.: 15/740,434

(22) PCT Filed: Jun. 29, 2016

(86) PCT No.: PCT/EP2016/065214
§ 371 (c)(1),
(2) Date: Dec. 28, 2017

(87) PCT Pub. No.: WO2017/001524
PCT Pub. Date: Jan. 5, 2017

(65) Prior Publication Data

US 2018/0168897 A1 Jun. 21, 2018

(30) Foreign Application Priority Data

Jun. 29, 2015 (EP) ..... 15174239

(51) Int. Cl.
*A61G 1/02* (2006.01)

(52) U.S. Cl.
CPC ..... *A61G 1/0281* (2013.01); *A61G 1/0268* (2013.01)

(58) Field of Classification Search
CPC ..... A61G 1/0268; A61G 1/0281
USPC ..... 16/32–35 R
See application file for complete search history.

(56) References Cited

U.S. PATENT DOCUMENTS 1,171,886 A * 2/1916 Ray ..... A01B 3/14 172/356
3,930,551 A * 1/1976 Cragg ..... A61G 5/045 180/65.6
3,995,504 A * 12/1976 LaManna ..... G06K 13/20 74/143
5,308,094 A * 5/1994 McWhorter ..... B25H 1/04 269/17
5,348,326 A * 9/1994 Fullenkamp ..... A61G 7/00 280/43
6,360,836 B1 * 3/2002 Milano, Jr. ..... B62B 5/005 180/65.6

(Continued)

*Primary Examiner* — Myles A Throop
(74) *Attorney, Agent, or Firm* — The Webb Law Firm

(57) ABSTRACT

A hospital bed, trolley or lifter includes a steering wheel mounted on a wheel support arm extending from which is a ratchet mechanism which can co-operate with a tooth of an adjustment mechanism. When the tooth is engaged in the ratchet teeth of the ratchet mechanism the wheel can be raised and held in the raised position until the tooth is disengaged. The wheel adjustment mechanism also includes an eccentric wheel for raising the tooth in a periodic manner to cause periodic raising of the wheel. A damper is attached to the support arm for dampening the drop of the wheel when the tooth is disengaged. A mechanism provides a steering wheel which can be held at intermediate positions between its uppermost and lowermost positions and which can be held in an engaged position in a plurality of different positions relative to casters of the bed or trolley. The system can also make use of a small capacity drive motor whilst still retaining speed of operation.

21 Claims, 9 Drawing Sheets

(56) References Cited

U.S. PATENT DOCUMENTS

| | | | | |
|---|---|---|---|---|
| 6,598,247 | B1 * | 7/2003 | Heimbrock | A61G 7/08 296/20 |
| 6,752,224 | B2 | 6/2004 | Hopper et al. | |
| 9,271,887 | B2 * | 3/2016 | Schejbal | A61G 7/018 |
| 2003/0159861 | A1 | 8/2003 | Hopper et al. | |
| 2004/0159473 | A1 * | 8/2004 | Vogel | A61G 7/00 180/9.1 |
| 2005/0126835 | A1 | 6/2005 | Lenkman | |
| 2009/0189135 | A1 * | 7/2009 | Van Der Westhuizen | B25H 1/0014 254/93 H |
| 2010/0181122 | A1 | 7/2010 | Block et al. | |
| 2011/0277241 | A1 | 11/2011 | Schejbal | |
| 2012/0198620 | A1 * | 8/2012 | Hornbach | A61G 7/08 5/510 |
| 2014/0041119 | A1 * | 2/2014 | Thodupunuri | A61G 7/08 5/510 |

* cited by examiner

WHEEL DRIVE MECHANISM FOR PATIENT HANDLING EQUIPMENT

CROSS-REFERENCE TO RELATED APPLICATIONS

This application is the United States national phase of International Application No. PCT/EP2016/065214 filed Jun. 29, 2016, and claims priority to European Patent Application No. 15174239.2 filed Jun. 29, 2015, the disclosures of which are hereby incorporated in their entirety by reference.

BACKGROUND OF THE INVENTION

Field of the Invention

This application relates to a wheel drive mechanism for patient handling equipment such as medical beds, trolleys, patient lifts, surgical tables, etc. having castors for travelling over surfaces, including slopes, uneven and even surfaces which can affect the steering and/or drive force of the patient handling equipment. The mechanism may include a free rolling or a powered wheel.

Description of Related Art

Mobile patient handling equipment typically rely on castors having low rolling resistance, both in terms of their direction of movement and of their ability to swivel and change direction, to facilitate transport. This gives the patient handling equipment advantageous features, such as reduced force required to move the patient handling equipment and its payload from one location to another. In order for a single person to be able to handle such patient handling equipment, it is advantageous to have some sort of steering capability.

Steering capability of patient handling equipment, in the form of beds or trolleys, may be realized by the provision of a 5th wheel, typically a non-swivelling wheel, located in the centre of the patient handling equipment, such as that disclosed in U.S. Pat. No. 6,752,224.

Engaging and disengaging the steering capabilities of the system introduces vibrations in the system to various extents, which are considered stressful for the patient, some patients being very sensitive. Especially unwanted are 'shock-loads', that is those generated by a 5th wheel being engaged with a high load to the floor.

Furthermore, in order for the bed or stretcher or lifter to work as efficiently as the user expects, it important that commands are carried out in a timely manner. That is, if the user wants to move the patient handling equipment sideways and commands the wheel to disengage from the floor, the user expects this to be realized in the same timeframe as would have occurred by means of, for example, a foot pedal, which is practically immediate or in the range of under a second.

Existing systems which engage or dis-engage a 5th wheel by a power assisted propelling system do so by means of a motor since they have to apply the extra loading to the 5th wheel needed to generate enough traction on the floor and it is not desirable to have the user manually apply this extra loading.

Existing systems suffer mainly from various drawbacks including: attempts made to address the response time by engaging or disengaging the wheel in a short time, for instance in under 1 second, commonly 'slam' the wheel towards the floor, introducing unwanted shock vibrations into the system; attempts made to engage or disengage the wheel smoothly to the floor suffer from slow response time, resulting in unwanted time lag from a user's perspective; those systems which try to solve the response time issue by adding faster components capable of handling the necessary loadings suffer from high component and system costs.

In the field of patient handling equipment such as beds and trolleys utilizing a 5th wheel for steering ability and/or propulsion there are different ways this 5th wheel is engaged or disengaged to the floor. When the wheel is retracted from the floor (disengaged), this is universally done by lifting it to the highest position that it can have while being deployed. As such, these devices all have a fairly long range of motion, resulting in extensive control times or/and high cost components to overcome the response time issue.

SUMMARY OF THE INVENTION

The present disclosure seeks to provide improved patient handling equipment and wheel drive mechanism for such equipment. The system is particularly suitable for hospital beds, trolleys, tables or lifters.

According to an aspect of the present disclosure, there is provided a patient handling assembly including a frame, a patient support carried by the frame, a plurality of castors attached to the frame, and a steering wheel mechanism coupled to the frame, the steering wheel mechanism including an adjustable wheel support member, at least one wheel member attached to wheel support member, the wheel support member being adjustable between a wheel uppermost position and a wheel lowermost position, the steering wheel mechanism including an adjustment mechanism coupled to the wheel support member able to adjust the position of the wheel support member to one of a plurality of intermediate positions between said wheel uppermost and lowermost positions.

According to another aspect, the disclosure is directed to a patient handling assembly including a frame, a patient support surface for supporting a patient, a plurality of castors attached to the frame and a steering wheel mechanism coupled to the frame. The steering wheel mechanism may include a wheel and a wheel support assembly, which is attached to and configured to adjust the wheel between a first state in which the wheel is deployed and a second state in which the wheel is elevated. An adjustment mechanism may further be coupled to the wheel support member to adjust the position of the wheel to one of a plurality of intermediate positions between the first and second states.

The assembly is such that it enables the steering wheel, typically the 5th wheel, to be moved to a plurality of positions between the wheel engaged and the wheel disengaged positions. In practice, the steering wheel can be held in an intermediate position, so as to reduce or minimise the travel required to re-engage with the floor or to be raised completely.

In practice, the wheel uppermost position is a wheel raised position and the wheel lowermost position is a wheel engaged position.

Advantageously, the adjustment mechanism is able to lock the wheel support member in position when the wheel is raised, such as by an uneven or humped ground surface. This may be achieved by a one-way locking mechanism, such as a ratchet mechanism. In this way, each time the wheel is caused to rise, it can be locked in the risen position, either for subsequent release or to be raised further.

Advantageously, the adjustment mechanism is disengageable to release the wheel support and the wheel coupled thereto. There may be provided a damper to dampen free movement of the wheel support when the adjustment mechanism is disengaged.

The wheel support mechanism may also provides a raising device for raising the wheel support incrementally, may over a plurality of lifting periods. The wheel support mechanism may include a motorised lifting device for generating the lifting motion. The motorised lifting mechanism may provide a periodic raising motion.

The steering wheel mechanism may include a locking element for locking the wheel support member in position. The locking member may be selectively engageable and disengageable. In one embodiment, the locking mechanism is movable relative to the chassis to cause the wheel support mechanism to move when locked to the locking mechanism towards a wheel raised position.

The wheel support is advantageously pivotably coupled to the steering wheel mechanism and movable pivotally to raise and lower the wheel or wheel connected thereto.

The wheel support mechanism may be able to lower the wheel or wheels attached thereto below a plane of the castors. The wheel support mechanism may also or in the alternative be able to raise the wheel or wheels attached thereto above a plane of the castors, with the wheel or wheels in a ground engaging condition.

Advantageously, there is provided a biasing member operable to bias the wheel support mechanism into lowered, a wheel engaged position. The biasing member may be damped.

The embodiments described herein seek to provide a system that has a fast response time, reduced vibrations while engaging the wheel, manual override capabilities, and a cost effective design resulting in a superior 5th wheel system that can be applied to all beds and trolleys.

Since almost all side movements of the patient handling equipment are generally carried out on a flat surface, that is not while driving along any slopes which might cause the 5th to be above or below the plane of the castors, it is only necessary to lift the wheel a small distance, that is a fraction of the range of motion the wheel needs to accommodate for slopes and obstacles. This insight leads to a system as disclosed herein, which lifts the wheel a fixed distance relative to its existing vertical position, in contrast to current systems which lift the wheel a fixed distance relative the chassis of the system irrespective of wheel's existing vertical position.

The described systems are able to lift the wheel by a distance relative the current vertical position, which results in the ability to use a relatively low geared small motor, more economical than a bigger or faster motor, for the lifting movement, as it is only required to move the wheel a short distance. As a result too, the response time can still be rapid, for instance under one second. Current systems that lift such wheels first have to 'collect all slack' in the system provided to accommodate for vertical change in wheel contact to the floor, before the wheel begins to move upwards. The same applies for movement in the opposite direction, where the system has to lower the wheel to the floor and continue the movement 'to create slack' in the system—all in all resulting in longer response times with low geared small motors.

The apparatus described herein also provides the possibility of manually overriding the 5th wheel in case of power failure and/or motor failure, as such failures render an otherwise functional bed or stretcher inoperable as far as manoeuvrability is concerned. Current motorized deployment systems for 5th wheel on beds or trolleys or similar load carrying apparatus such as lifters, carts do not have such a facility.

BRIEF DESCRIPTION OF THE DRAWINGS

Embodiments of the present disclosure are described below, by way of example only, with reference to the accompanying drawings, in which.

DESCRIPTION OF THE INVENTION

Figure 1A:
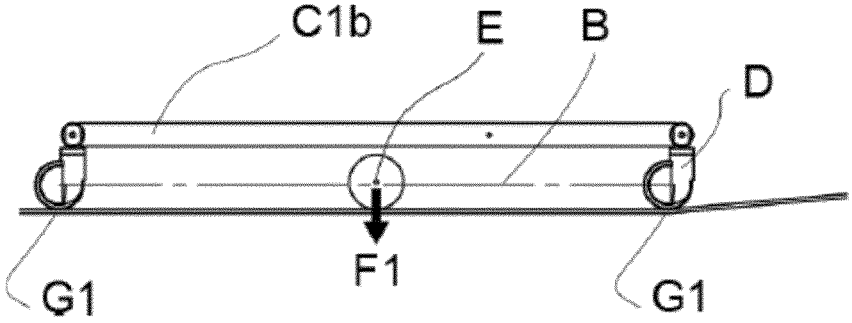
FIG. 1A shows a side elevational schematic view of an example of hospital bed or trolley having a fifth wheel on a flat surface.

Referring to FIG. 1A a mobile patient handling equipment, such as a bed, a stretcher, trolley, surgical table, patient lift, etc., has a frame or chassis C1*b* that connects a plurality of castors D, at least three to provide a stable design and may include four castors, for example, one at each corner of the chassis. The castors have ground contact surfaces G1, G2, G3, rolling properties and swivelling properties to give the chassis C1*b* the ability to transport, maneuver, handle its payload, which may be in the form of additional mass that makes up the bed or stretcher, goods to be supported and/or a patient to be supported.

The chassis C1*b* may have steering assistance capabilities by deploying one or more additional, steering wheels E into contact with the ground. The steering wheel E, which in one embodiment may not be able to swivel, applies a force F1 towards the ground to prevent or minimise unwanted sideways movement of the chassis C1*b*. The force F1 may be generated in proportion to the payload of the chassis C1*b*, the friction properties of the ground, the friction properties of the ground contact surface of the additional wheel E and/or the speed of the system at the moment of the desired direction change.

The patient handling equipment may additionally have propulsion assistance functionality by providing to the additional wheel E a propulsion mechanism able to propel the patient handling equipment, in which case the force F1 will also be proportional to the desired acceleration/deceleration by the propulsion wheel to the patient handling equipment and/or to the angle of incline to which the patient handling device is subjected. An exemplary propulsion mechanism may be a suitable electric motor. In one embodiment, a fairly consistent force F1 is generated by the steering wheel E, regardless of the vertical position of the wheel E with respect to plane B through the centres of the castors D.

Figure 1B:
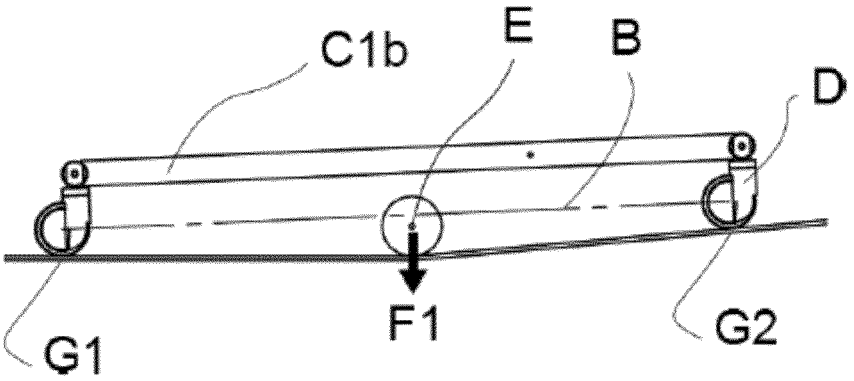
FIG. 1B shows a side elevational schematic view of the example of hospital bed or trolley of FIG. 1A on a convex surface.

Referring to FIG. 1B the mobile patient handling equipment is shown positioned on a non-flat surface having different surface elevations and levels in which the contact points G1 and G2 are at different vertical heights, which may for example be the result of travelling up or down a slope. As a result of the concave form of the ground surface, that is a slope which is increasing, the steering wheel E will as a result have a different vertical positions in respect to the plane B through the centres of the other castors D. The height or distance by which the additional wheel E drops down in the vertical direction may be related to the change in slope between the contact points G1 and G2, the horizontal distance between contact points G1 and G2 and/or the position of the additional wheel E between contact points G1 and G2. The maximum influence on the vertical position of the additional wheel E will be realized if it is evenly spaced between contact points G1 and G2. In one embodiment there is an evenly spaced placement of an additional wheel between the swivelling castors D to facilitate steering capabilities of the patient handling equipment in the form of beds, trolleys or lifters.

Figure 1C:
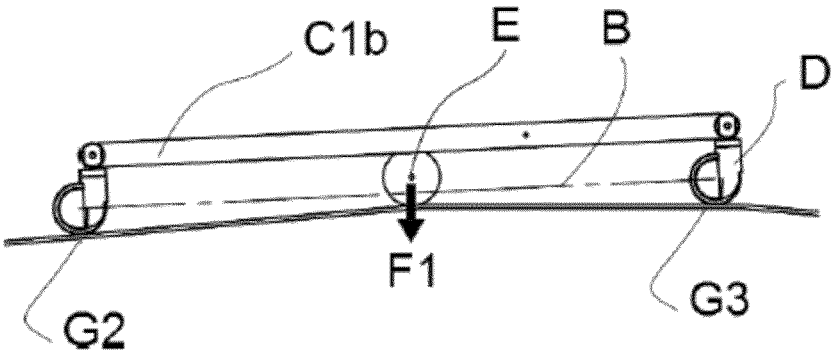
FIG. 1C shows a side elevational schematic view of the example of hospital bed or trolley of FIG. 1A on a concave surface.

Referring to FIG. 1C, the mobile patient handling equipment is shown located with its swivelling castors D on a ground surface which curves downwardly, specifically in what could be called a convex manner, between the contact points G2 and G3. This may for example be the result of passing over a crest or bump in the ground. Under these circumstances, the additional wheel E will, as a result have a different vertical position in respect to the plane B between the centres of the castors D, rises upwardly, that is towards the chassis C1*b*.

Figure 2:
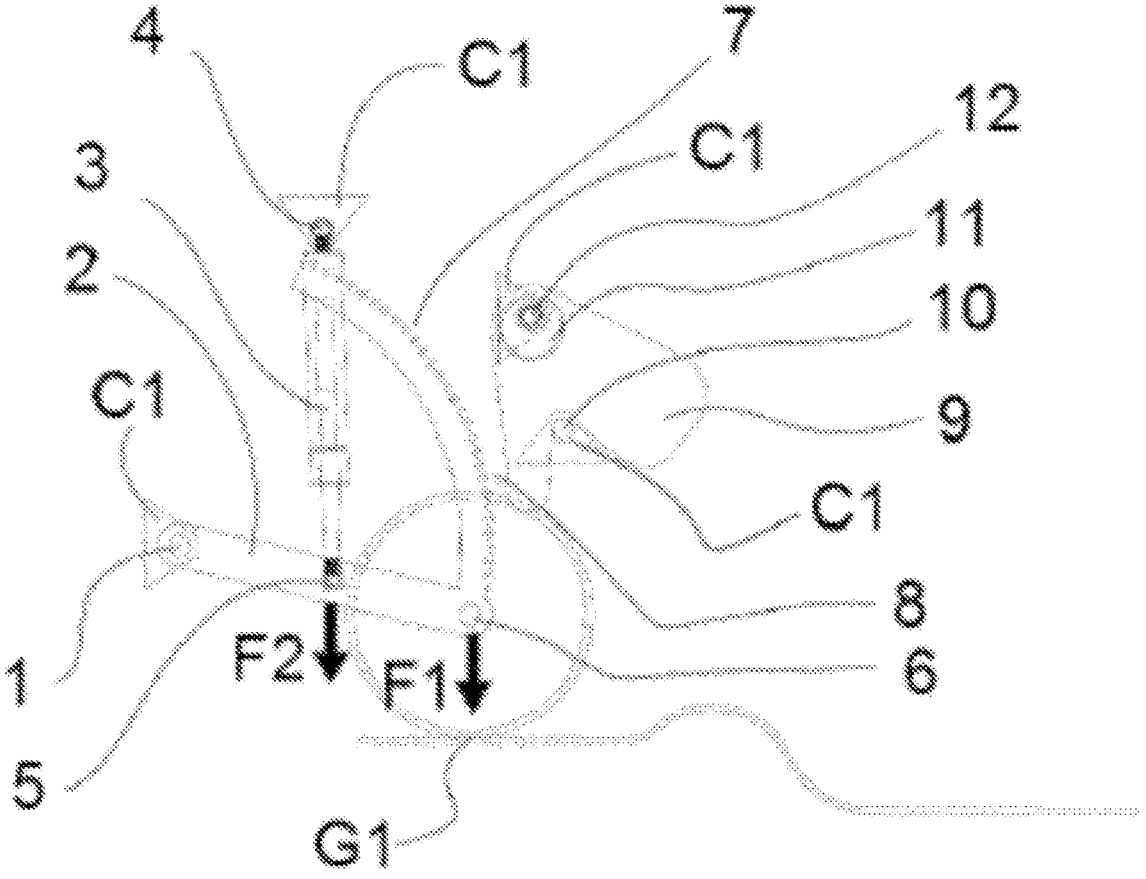
FIG. 2 shows a schematic diagram of one embodiment of a fifth wheel assembly in a first state in which wheel E is in contact with an even ground surface.

Referring to FIG. 2, the patient handling equipment may further include a wheel assembly and system for deploying, lifting and driving wheel 6. The principles of the additional wheel, which may in some embodiments be referred to as the fifth wheel, are shown. The wheel 6 may provide propulsion also, by being coupled to a motor (not shown) via a mechanism for transferring the motor power to the wheel 6. This may, for instance, simply be a rotational shaft attached to the wheel or may have a clutch and/or gear arrangement for allowing the wheel 6 either to be a propulsion wheel or to be freewheeling. In order for the wheel 6 to provide propulsion and/or steering to the patient handling equipment, it is necessary for the wheel 6 to be in contact with the ground with sufficient pressure to transfer the forces needed to propel and/or steer, this force being depicted by the arrow F1. Force F1 may be advantageously substantially consistent regardless of the vertical position of the wheel 6 caused by a varying ground surface. The force F1 is transferred, conveyed and/or provided to wheel 6 through rigid link 2, which is rotationally attached at pivot 1 of the chassis C1 of the patient handling equipment. A force F2 acts along the link 2 at a connection point 5, wherein the downward direction of force F2 directs the wheel 6 towards the ground. Force F2 may be realized by a spring 3 attached at a fixing point 4 between the chassis C1 and the connection point 5 on the link 2. The spring 3 is may be a gas spring, wherein the fairly flat gas spring characteristics make it suitable for providing a substantially consistent force F1 regardless of the vertical position of the wheel 6. Other types of springs may be also be used, such as a coil or wrap spring, compression springs, a leaf springs or torsion springs configured to provide similar results and application of force.

The wheel 6 may be free to continuously follow and/or engage the changing contours and contact points of the ground G as the patient handling equipment travels over the ground G. For example, link 2 may move between two extremes, an upper most vertical position and a lower most vertical position of wheel 6 that is dictated by the range of motion of the spring 3, being attached to the link 2 at pivoting connection point 5 and the chassis C1 at pivoting connection point 4. This is the case as long as no locking part (described below) interacts with the holding part 7 having a ratchet configuration and rigidly attached to the link 2. Holding part 7 may be located anywhere along the link 2, e.g. anywhere along its length or extensions thereof, including before or after C1 rotational contact point 1 or as part of the C1 rotational contact point 1. Placement of the holding part 7 further away from C1 rotational point 1 will allow for a greater range of motion and therefore a larger displacement of holding part 7 in relation to the vertical position of the wheel 6.

The holding part 7 is graspable by a gripper 8 to secure wheel 6 in a raised position, which in one embodiment may include a locking teeth, saw teeth, ratchet teeth and/or cogs able to engage the ratchet surface of the holding part 7 and able to urge the wheel 6 upwards and away from the ground G in that the holding part 7 can rotate the link 2, described in detail below.

The locking tooth configuration of gripper 8, can be decoupled from the holding part 7 to lower wheel 6 and enable contact with ground G by being guided away from the holding part 7 by a guide 10, which may be static relative to the chassis C1 and act upon a curved surface on the body 9 of the gripper 8. This curved surface urges the gripper 8 away or against the holding part 7 as a result of the variable position of the gripper 8. It is understood that the guide 10 may be in the form of a pin a roller or any other suitable member to guide the gripper 8 in a curved motion on the body 9 of gripper 8. It is also understood that the opposite arrangement is equally suitable. Other embodiments for guiding the gripper 8 away or against from the holding part 7 may include but are not limited to, a servo motor arranged actively to control the position of the gripper 8.

The gripper 8 is also able to act on and engage the holding part 7 in a way that allows the holding part 7 be free to move in a direction that urges the wheel 6 away from the ground if so dictated by a change in the vertical position of the contact point G1 and at the same time limits or stops the holding part 7, though the link 2, from rotating in the opposite direction that moves the wheel 6 towards the ground. This is achieved in the embodiment shown by having teeth of the holding part 7 angled downwardly such that the tooth 8 of the gripper can slide over the teeth in one direction (upwardly) but becomes trapped between two teeth in the opposite (downward) direction.

The gripper 8 is also able to urge the wheel 6 away from the ground G, that is to raise it. This can be achieved by means of the actuator 11, operated by drive member 12, coupled to the body 9 of the gripper 8, which is able to displace the gripper 8 by displacing the actuator 11. The drive member 12 may be rigidly coupled to a low geared rotational motor, a foot operated lever, a hand operated lever or any other suitable arrangement for moving the member 12 to change the position of actuator 11. Actuator 11 may be in the form of an eccentric shaft able to move the body 9 of gripper 8 a suitable distance to urge the wheel 6 away from ground G, achieved in that the holding part 7 is gripped by the gripper 8 and displaced a distance related to the actuator 11 motion. Other embodiments of translating actuator 11 will be apparent to the person skilled in the art, such as, but not limited to, an electric linear actuator, a pneumatic cylinder or a solenoid and so on.

The movement raising the wheel 6 can be reversed to bring the wheel 6 back into contact with the ground. Having the actuator 11 in the form of an eccentric shaft can be advantageous since it will bring the wheel 6 towards the ground in a gentle way in light of the sinusoidal rotary motion of the eccentric shaft arrangement.

Figure 3:
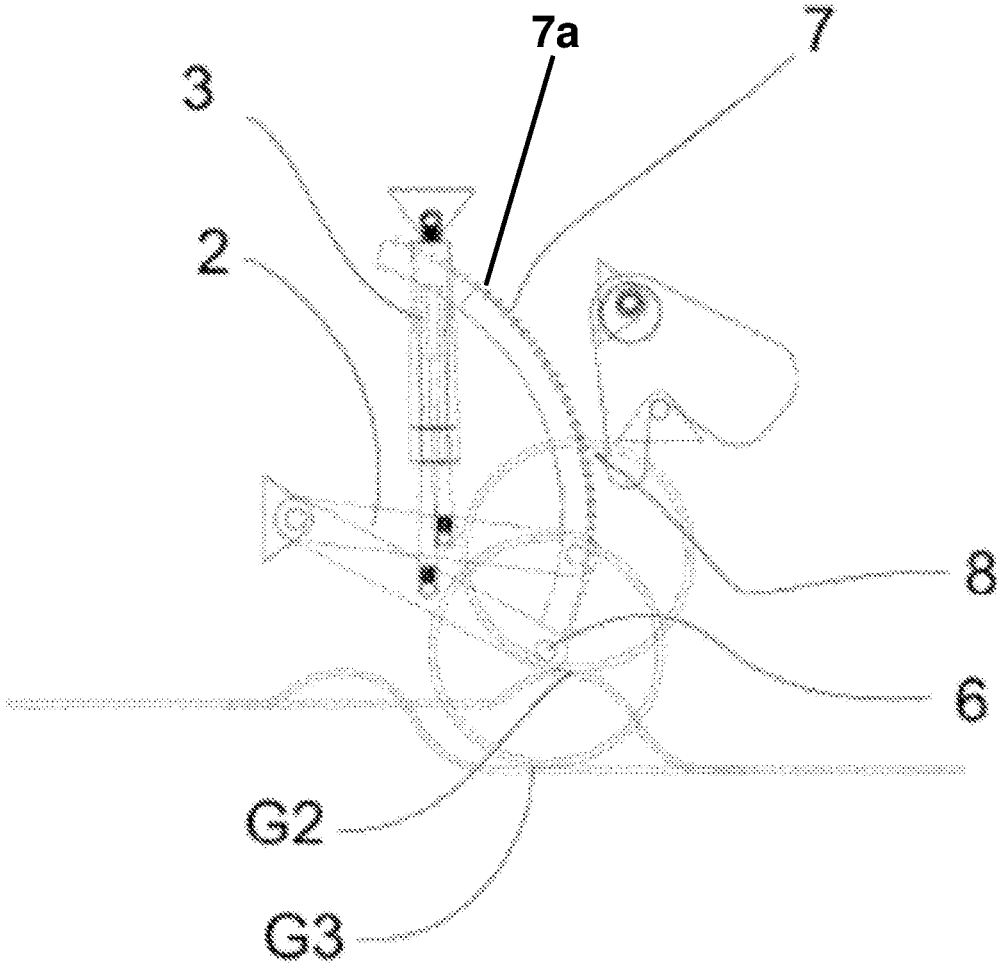
FIG. 3 shows a schematic diagram of the fifth wheel assembly embodiment of FIG. 2 in a second state as the fifth wheel E travels over an obstacle.

Referring to FIG. 3 the gripper 8 is shown in a state where the wheel 6 adds a propulsion and/or steering function to the patient handling equipment, as it is urged away from the holding part 7, including tooth 7*a*, giving the link 2 freedom to let the wheel 6 follow the ground as illustrated by the different ground contact points G2 and G3, while the spring 3 maintains the contact between the ground points G2, G3 and the wheel 6.

Figure 4:
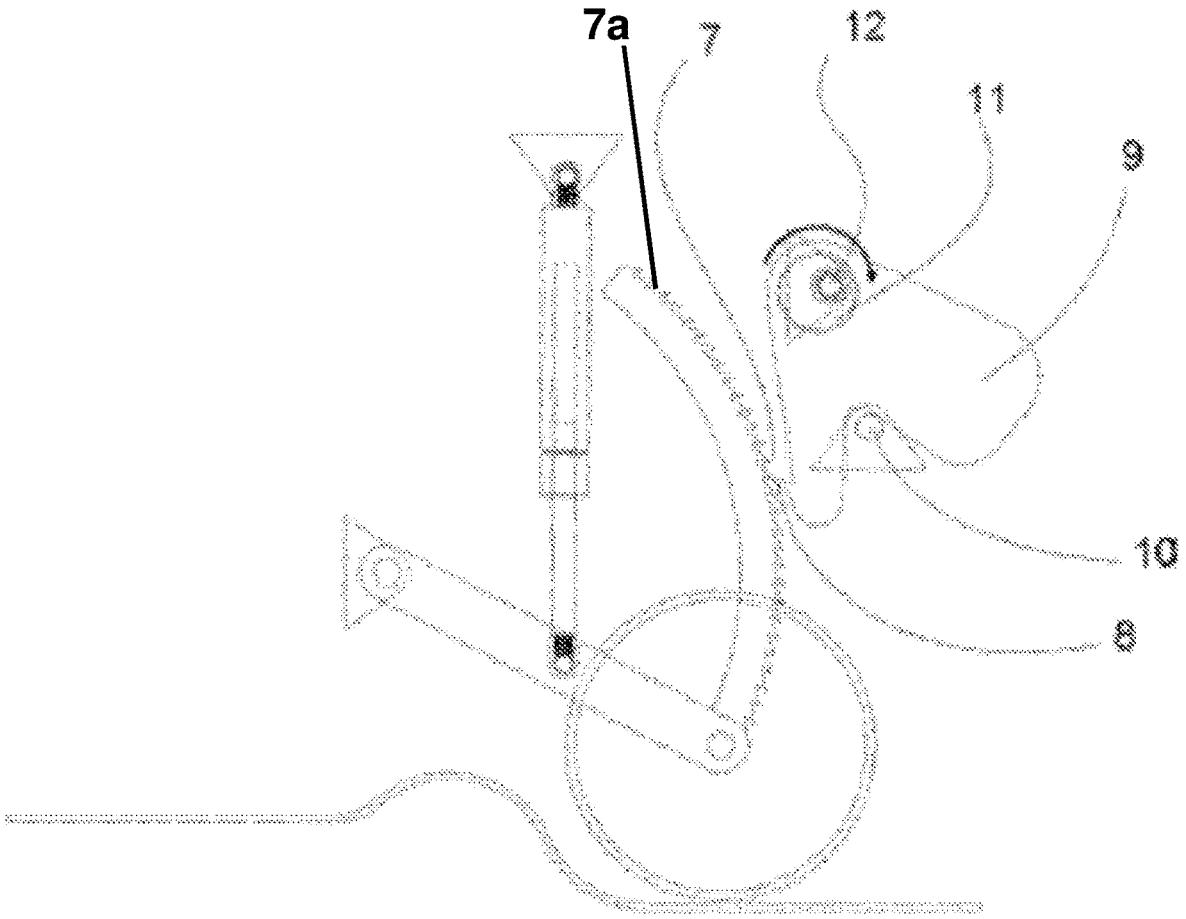
FIG. 4 shows a schematic diagram of the fifth wheel assembly embodiment of FIG. 2 in a third state after the fifth wheel E has traveled over an obstacle.

Referring to FIG. 4 the gripper 8 is shown in a state where it is put in contact with a tooth 7*a* of the holding part 7 in that the guide 10 no longer urges the body 9 of the gripper 8 away from the holding arm 7 as a result of the actuator 11, in the form of an eccentric wheel, being rotated by drive member 12. As the body 9 is rotationally attached to actuator 11 and has a mass distribution so as to urge the gripper 8 against the holding part 7, the guide 10 does not have to guide the body 9 towards the holding part 7.

Other embodiments of devices for urging gripper 8 against the holding part 7 will be apparent to the person skilled in the art, such as, but not limited to, a spring, a rotational spring or a torsion spring, used together or instead of the mass distribution of the body 9.

Figure 5:
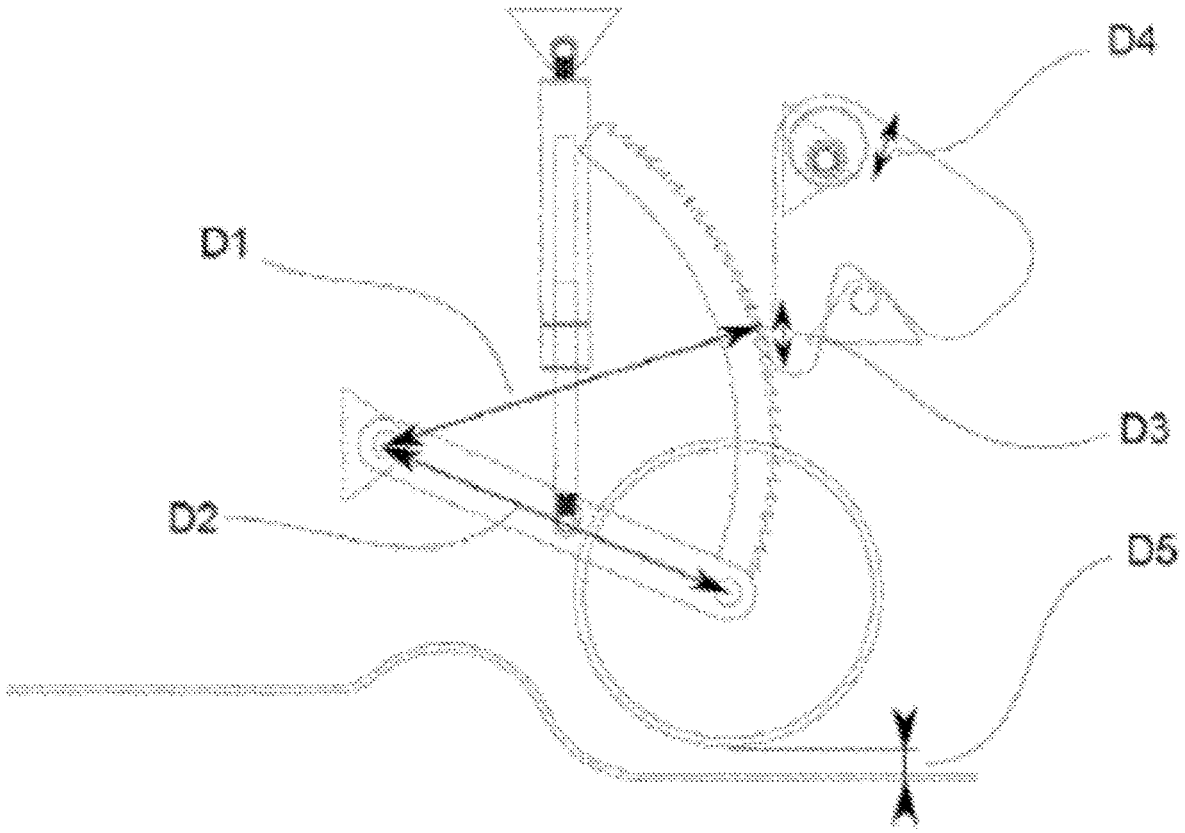
FIG. 5 shows a schematic diagram of the fifth wheel assembly embodiment of FIG. 2 in a fourth state as the fifth wheel E is lifted.

Referring to FIG. 5, further rotation of the drive shaft 12 causes the eccentric guide 11 to move upward, which causes the gripper plate 9 and as a consequence the gripper tooth 8 to move upwardly. This also pulls the ratchet holder 7 upward, and as a result the wheel 6 off the ground. In the embodiment shown, each upward cycle of the eccentric guide 11 causes a upward movement of distance D3 as shown in FIG. 5, which is translated to an upward movement of D5 of the wheel 6 as a result of the lever effect of the pivotable arm 2 about the pin 1.

Figure 6:
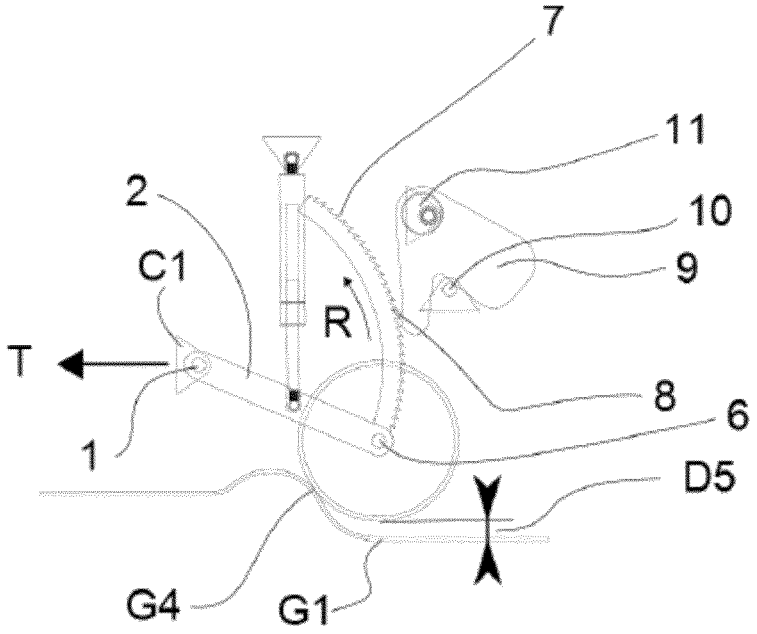
FIG. 6 shows a schematic diagram of the fifth wheel assembly embodiment of FIG. 2 in a fifth state as a gripper engages the holding ratchet member.

Referring to FIG. 6, the wheel 6 is shown in a position urged away from the ground surface level G1 by a distance D5 as a result of the body 9 being moved by actuator 11 so that the gripper 8, being in engagement with the holding part 7, rotates link 2 around the attachment point 1. When the patient handling equipment, in the form of a bed or a trolley or lifter having a chassis C1, travels in a direction T, the wheel 6 may encounter a contact point or bump G4 vertically higher than the distance D5. By allowing the gripper 8 to be pushed away from the holding part 7 as a result of the movement R of the holding part 7 and the orientation of the teeth of the ratchet face of the holding part 7, the wheel 6 is free to roll over the higher contact point G4 during the travel of the chassis C1 in direction T. The guide 10 does not restrict the body 9 of the gripper 8 from moving away from the holding part 7 and the urging force on the gripper 8 is suitably low to allow the gripper 8 to move away from the holding part 7 to allow the teeth to slide upwardly. The gripping characteristics of the gripper 8 and the holding part 7 are such that the holding part is free to travel in one direction but not in the other, achieved in this embodiment by the angled arrangement of the teeth, so as to grip in one direction and slide in the other direction. Other embodiments for providing one-way fixation between gripper 8 and holding part 7 will be apparent to the person skilled in the art, such as, but not limited to, a wrap spring acting upon a shaft rigidly connected to the link 2, a thin plate with a hole having sharp edges that when slightly angled against a structure of the arm 2 securely holds it and when being near perpendicular to the same structure let it slide, and so on.

Figure 7:
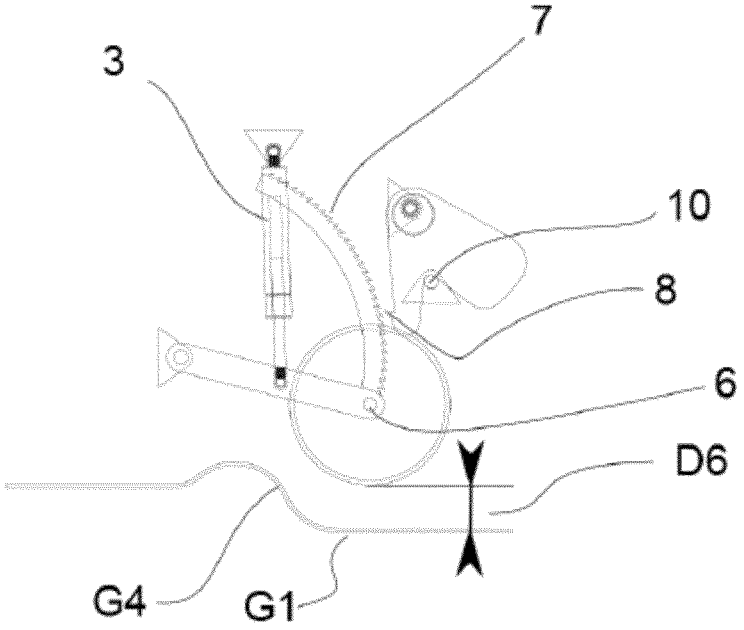
FIG. 7 shows a schematic diagram of the fifth wheel assembly embodiment of FIG. 2 in a sixth state as the fifth wheel E is secured in an elevated position.

Referring now to FIG. 7, the wheel 6 is urged towards the ground as the gripper 8 has been moved away from the holding part 7, by rotation of the eccentric actuator 11. As a result of having passed over the contact point G4, the wheel 6 has a clearance from the distance of D6 greater than the distance D5 of FIG. 6. As the gripper 8 only controls the movement of the holder 7 until it is urged away from the holder 8 by the guide 10, it will in this circumstance have no control of the last part of the travel of the wheel 6 towards the ground contact point G1, the distance being approximately equal to the vertical distance D6 minus the vertical distance D5. It is therefore advantageous if the spring 3 has damping properties. Such damping properties of the spring 3 may be realized by using an oil damped gas spring, or other arrangement commonly known in the art, for example but not limited to, sliding elements in high viscous fluids or elastomers having viscoelastic properties.

Figure 8A:
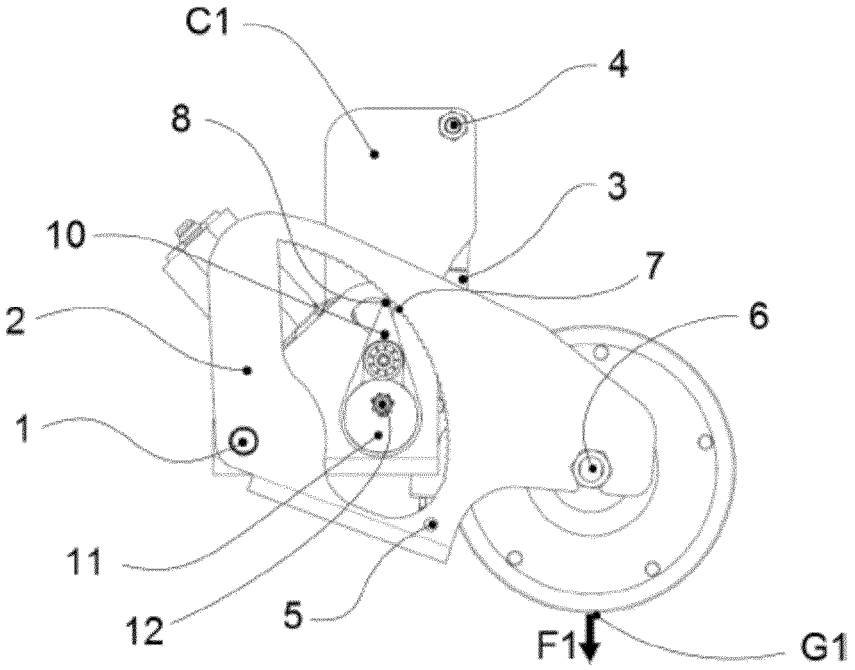
FIG. 8A shows another embodiment of a drive wheel assembly according to the application.
Figure 8B:
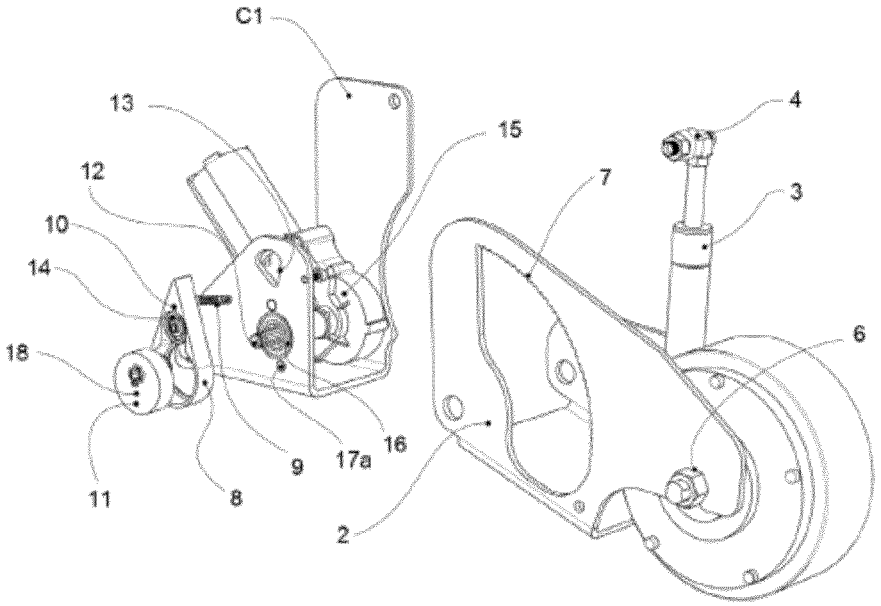
FIG. 8B shows the components of the drive wheel assembly of FIG. 8A.
Figure 8C:
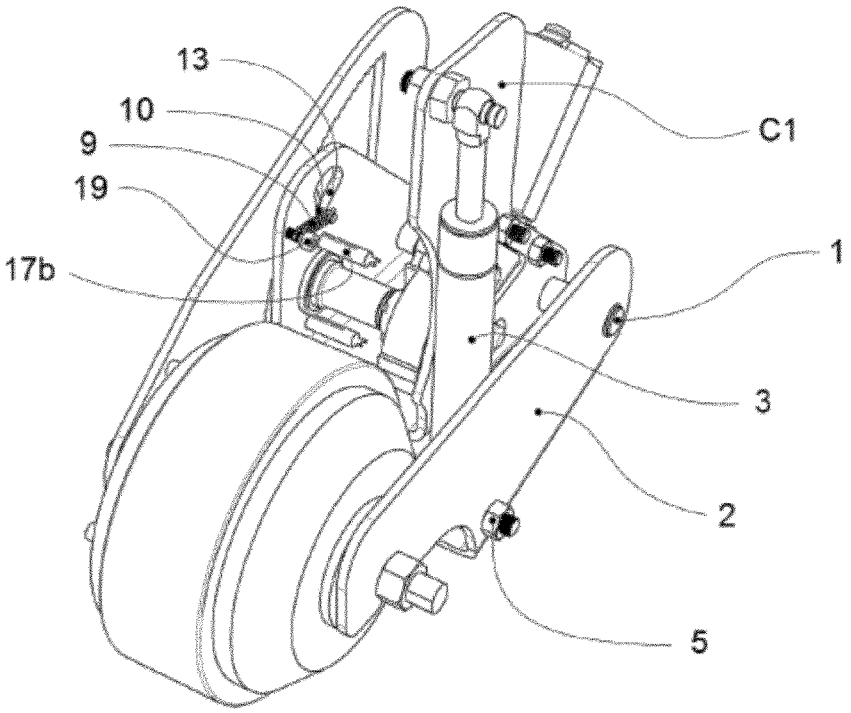
FIG. 8C shows an elevated perspective view of the drive wheel assembly of FIG. 8A.

Referring now to FIGS. 8A, 8B and 8C an exemplary practical embodiment is shown, having a rigid connection to the patient handling equipment by means of the rigid part C1, which may be a part of the chassis of a bed or a trolley for instance. The link 2 is rotatably connected to the chassis C1 by the attachment point 1, that may be in the form of a shaft, a screw, a rivet or any other suitable rotary element capable of transferring the forces needed to support the link 2 and the forces resulting from the wheel 6 when in contact with the ground. The link 2 may be in the form of a sheet metal part or any other suitable material or combination of materials or design capable of transferring the forces when the wheel 6 is in contact with the ground. The link 2 can be urged towards the ground by the spring 3, here shown as a gas spring having a force in the range of 650-750 N and a damped motion in the range of 0.1-0.3 m/s. It is to be understood, as earlier described, that the spring may have other forms, and/or it may be rotatably connected to the chassis C1 by point 4 and the link 2 by point 5. The points 4 and 5 are shown as bolts but may be in any form commonly used to connect a rotatable element. Connection point 5 is spaced apart from attachment point 1 and wheel 6, in such a way that the resulting force F1 will be in the range of about 350 N-450 N. The link 2 has saw tooth surface which gives one-way gripping capabilities to the holding part 7, which is rigidly integrated in link 2, which is spaced from attachment point 1 and wheel 6 in such a way that vertical displacement of the holding part 7 results in approximately double the vertical displacement of the wheel 6. Unlike the embodiments of FIGS. 2-7, holding means 7 and gripper 8 is positioned between C1 attachment point 1 and wheel 6.

The gripper 8 will be guided away from the holding part 7 by a guide 10 as it 5 is actuated by the actuator 11. Gripper 8 may be in the form of a milled metal part or any other suitable material or combination of materials and/or design capable of overcoming the force from the spring 3 to urge the wheel away from the ground G1.

The actuator 11 has an eccentric design that shifts the rotational centre of 10 the gripper 8, in this example in a range of about 10 mm-15 mm, as it rigidly attached to the member 12 that is rotated by the low geared motor 15, having in this example a torque in the range of 5-12 Nm and a speed in the range of about 25 rpm-35 rpm. The motor may be of the brushed commutator type and run by direct current. In other embodiments the low geared motor 15 may be of a brushless DC motor having similar performance characteristics. The actuator 11 may be in the form of a milled metal part or any other suitable material or combination of materials and/or design capable of overcoming the force from the spring 3 to urge the wheel away from the ground G1.

It is advantageous if in one embodiment of the design, as shown, allows for the low geared motor 15 to run in one direction only, for example always clockwise to engage and disengage the wheel 6 to and from the ground G1, providing uniform wear of the internal parts of the low geared motor 15.

The actuator 11 and thus the member 12 are guided by a bearing 16, shown as a ball bearing, but any other type of commonly used bearing may be used. Actuator 11 acts upon gripper 8 via a bearing 14 attached at its centre to the gripper 8 and extending around the periphery of the actuator 11. Other arrangements may be used, such as but not limited to a polymer plain bearing, a brass polymer bearing, a needle bearing, a material combination between actuator 11 and gripper 8 with suitable bearing characteristics, and so on.

Member 12 which drives the actuator 11 is shown as a splined shaft able to transfer the rotary moment of the low geared motor 15. Member 12 may advantageously be made of extruded aluminium, but other material may be used, such as but not limited to high strength injection moulded plastics or metal, or may be an integral part of the low geared motor 15 outgoing shaft.

The guide 10 urges the gripper 8 away from the holding part 7, being guided by the path of the curve 13 forms in the chassis part C1. The gripper 8 is 5 urged towards the holding part 7 by the spring 9 as soon as the curve 13 allows the guide 10 to bring the gripper 8 into contact with the holding part 7. The spring is an extension type spring in this embodiment, but any other commonly available spring element may be used. The spring 9 is attached at one end to the gripper 8 by the guide 10 and at the other end to the chassis C1 by a screw 19, but any 10 other commonly available arrangement may be used to attach spring elements.

To determine when to start and stop the low geared motor 15 and/or tell whether the wheel 6 is engaged or disengaged towards the ground G1, there may be provided a pair of sensors 17*a* and 17*b* able to sense the presence of a magnet 18 representing the position of the actuator 11. The sensors 17*a* and 17*b* are spaced apart in a way that sensor 17*a* senses the presence of the magnet 18, representative of the wheel 6 being in an engaged state towards the ground G1, and sensor 17*b* senses the magnet 18, representative of the wheel 6 being in a disengaged state. Other arrangements of sensors, the singularity of a sensor or the absence of a physical sensor may be used, exemplified but not limited to, a 20 rotary counter, a current sensing arrangement of the low geared motor 15 or a visual feedback system in form of a camera, all for determining if the wheel is in a engaged or disengaged state towards the ground.

FIGS. 9A-9D show the operation of an exemplary wheel drive assembly similar to that of FIGS. 8A-8C. The systems are structurally and functionally the same with the exception that rigid link 2 of FIGS. 9A-9D has an open frame configuration, as opposed to the solid plate structure shown in FIGS. 8A-8C. As shown here, rigid link 2 may be a pivotable swing arm that supports and functions to move wheel 6 between raised and deployed positions. The following method of use therefore is equally applicable to both embodiments.

Figures 9A, 9B, 9C, 9D:
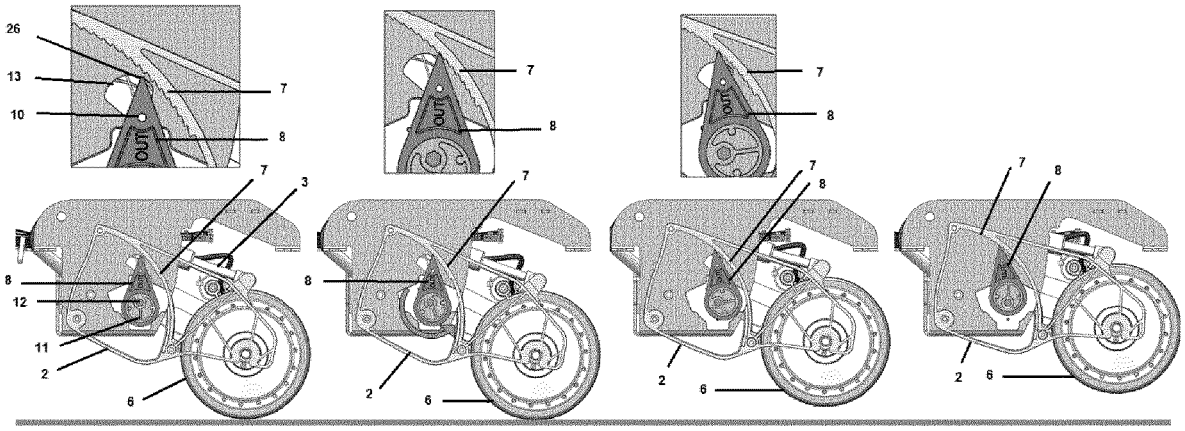
FIG. 9A is a schematic diagram of an exemplary drive wheel assembly with the wheel deployed.
FIG. 9B is a schematic diagram showing the wheel of FIG. 9A initiating lift.
FIG. 9C is a schematic diagram showing the wheel of FIG. 9A lifting the wheel.
FIG. 9D is a schematic diagram showing the wheel of FIG. 9D with the wheel raised.

As shown in FIG. 9A, wheel 6 is deployed such that it is oriented in a first state in which wheel 6 is fully lowered, engaging the ground in traction to steer and apply a force to the patient handling equipment. In FIG. 9A, eccentric actuator 11 is arranged in a corresponding first state in which a distal end of actuator 11 is oriented at its vertically lowest point. Gripper 8, configured as a lifting arm or pawl, is similar oriented in its lowest position. The lifting arm includes a pin configured guide 10 that moves is guided by a cam curve 13, which moves the lifting arm away from the ratchet teeth of holding part 7 as it travels along cam curve 13. When swing arm link 2 is decoupled from the lifting arm as shown in FIG. 9A, spring 3, configured here as a gas spring, is free to press swing arm link 2 and wheel 6 towards the floor.

As shown in FIG. 9B, actuator 11 is induced to rotate counterclockwise by actuator member 12 to initiate wheel lifting. Lifter arm configured gripper 8 also rises as pin guide 10 moves along cam curve 13, which moves the lifter arm towards ratchet holder part 7. The tip 26 of lifting arm gripper 8 thus engages and interlocks with ratchet tooth of holding part 7. Actuator 11 continues to rotate counterclockwise, as directed by a motor of chassis C1 and actuator member 12, to lift wheel 6 as shown in FIG. 9C. The lifter arm gripper 8, together with its interlocked holding part 7 and swing arm link 2, are thus raised. As illustrated, the gas spring is compressed, and the wheel 6 leaves the floor. At this point, pin guide 10 of the lifter arm has left cam curve 13, and the lifter arm is instead guided by the pivot point made up of lifting arm tip 26 and the ratchet tooth of holding part 7.

FIG. 9D shows the wheel 6 in a raised orientation in which actuator 11 is positioned in a second state where the distal end of actuator 11 is vertically elevated, opposite to that of the first state. As actuator 11 rotates, a magnet within a hub of actuator 11 communicates with system reed switches to instruct the control system when to stop the motor and maintain lifter arm 30, swing arm link 2 and wheel 6 in this raised position.

A small spring biases swing arm link 2 to the right to enable the ratchet functionality in that if the wheel rolls over an obstacle on the floor, the link can move upwards without falling down again. It ratchets up and stays up.

To lower wheel 6, the motor rotates actuator 11 counter clockwise thus lowering lifter arm gripper 8 and swing arm link 2. The continuous counterclockwise rotation allows for equal wear of the worm gears and motor. Referring to FIG.

10, patient handling equipment in the form of a bed or a trolley has a chassis C1*b* with a plurality of swivelling castors D which support the equipment on the ground surface G1. The chassis C1*b* is rigidly connected to the previously described chassis part C1. The wheel 6 is connected to the chassis via the rigid link 2 and the rotary point 1. In one embodiment, the wheel 6 is spaced between the supporting swivelling castors D.

Figure 10:
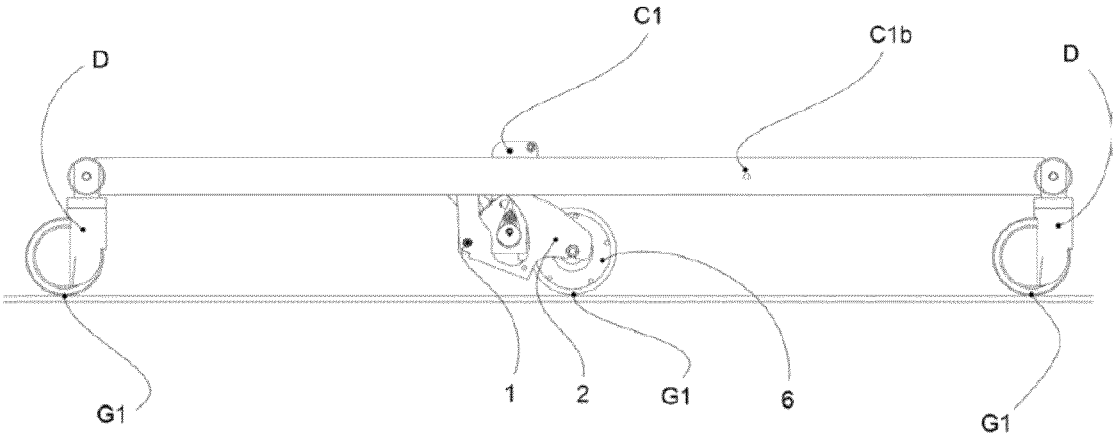
FIG. 10 is a side elevational view of a fifth wheel assembly having manual override capabilities, attached to a hospital bed or trolley in accordance with the present disclosure.
Figure 11:
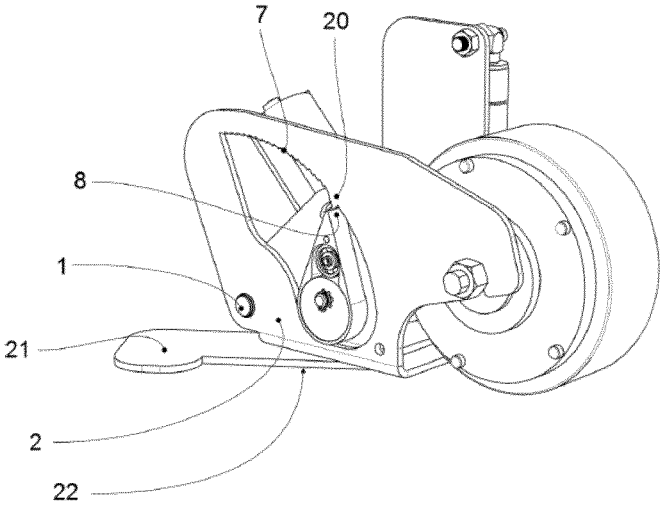
FIG. 11 is a perspective view of the fifth wheel assembly of FIG. 10.

Referring to FIGS. 10 and 11, an exemplary embodiment of the fifth wheel is disclosed having manual override capabilities. A lever 21 is provided together with a holding tooth 20 on the holding part 7. The holding tooth 20 has a geometry which holds the gripper 8 in place even if the gripper 8 is otherwise urged away from the holding part 7. Lever 21 can be an integral part of the link 2 but may also be retractable, having a jointed connection 22 to link 2, making it rigid in the rotational direction around attachment point 1 that urges the wheel away from the ground.

The invention claimed is:

1. A patient handling assembly comprising:

a frame;

a plurality of castors attached to the frame; and a steering wheel mechanism coupled to the frame, the steering wheel mechanism comprising an adjustable wheel support member, at least one wheel member attached to the wheel support member, said wheel support member being adjustable between a wheel uppermost position and a wheel lowermost position, the steering wheel mechanism comprising an adjustment mechanism comprising at least one tooth and an eccentric wheel, the adjustment mechanism coupled to the wheel support member and configured to adjust a position of the wheel support member to one of a plurality of intermediate positions between said wheel uppermost and lowermost positions, wherein the eccentric wheel of the adjustment mechanism is configured to raise the wheel support member and the wheel member in a periodic manner by engaging the at least one tooth.

2. The patient handling assembly according to claim 1, wherein the wheel uppermost position is a wheel raised position and the wheel lowermost position is a wheel engaged position.

3. The patient handling assembly according to claim 1, wherein the adjustment mechanism includes a locking device for locking the wheel support member in position.

4. The patient handling assembly according to claim 3, wherein the locking device is operable to lock the wheel support member in a plurality of positions.

5. The patient handling assembly according to claim 3, wherein the locking device includes a one-way locking mechanism.

6. The patient handling assembly according to claim 5, wherein the one-way locking mechanism is a ratchet mechanism.

7. The patient handling assembly according to claim 1, wherein the eccentric wheel of the adjustment mechanism is disengageable from the at least one tooth to release the wheel support and the at least one wheel member coupled thereto.

8. The patient handling assembly according to claim 1, further comprising a damper to dampen free movement of the wheel support when the adjustment mechanism is disengaged.

9. The patient handling assembly according to claim 1, wherein the adjustment mechanism further comprises a raising device for raising the wheel support incrementally.

10. The patient handling assembly according to claim 9, wherein the raising device is operable to raise the wheel support over a plurality of lifting periods.

11. The patient handling assembly according to claim 9, wherein the raising device comprises a motor for generating a lifting motion on the wheel support.

12. The patient handling assembly according to claim 11, wherein the motor and the adjustment mechanism generate a periodic raising motion.

13. The patient handling assembly according to claim 1, wherein the steering wheel mechanism comprises a locking element for locking the wheel support member in position.

14. The patient handling assembly according to claim 13, wherein the locking element is selectively engageable and disengageable.

15. The patient handling assembly according to claim 13, wherein the locking element is movable relative to the chassis to cause the wheel support mechanism to move when locked to the locking element towards the wheel uppermost position.

16. The patient handling assembly according to claim 1, wherein the wheel support is pivotably coupled to the steering wheel mechanism and movable pivotally to raise and lower the at least one wheel member connected thereto.

17. The patient handling assembly according to claim 1, wherein the wheel support mechanism is configured to lower the at least one wheel member attached thereto below a plane of the castors.

18. The patient handling assembly according to claim 1, wherein the wheel support mechanism is able to raise the at least one wheel member attached thereto above a plane of the castors, with the at least one wheel member in a ground engaging condition.

19. The patient handling assembly according to claim 1, further comprising a biasing member configured to bias the wheel support mechanism towards the wheel lowermost position.

20. The patient handling assembly according to claim 19, wherein the biasing member is damped.

21. The patient handling assembly according to claim 1, further comprising a manual override device for overriding the wheel support member.

* * * * *